US008597438B2

(12) United States Patent
Chandrasekaran et al.

(10) Patent No.: US 8,597,438 B2
(45) Date of Patent: Dec. 3, 2013

(54) USE AND METHOD OF PRODUCING A DISPERSION STRENGTHENED STEEL AS MATERIAL IN A ROLLER FOR A ROLLER HEARTH FURNACE

(75) Inventors: Dilip Chandrasekaran, Västerås (SE); Thomas Helander, Västerås (SE); Thomas Lewin, Hallstahammar (SE); Thomas Odelstam, Sandviken (SE); Jan Innerman, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 287 days.

(21) Appl. No.: 12/681,498

(22) PCT Filed: Oct. 5, 2007

(86) PCT No.: PCT/SE2007/050711

§ 371 (c)(1),
(2), (4) Date: Aug. 2, 2010

(87) PCT Pub. No.: WO2009/045136

PCT Pub. Date: Apr. 9, 2009

(65) Prior Publication Data

US 2010/0289194 A1 Nov. 18, 2010

(51) Int. Cl.
*C22C 38/06* (2006.01)

(52) U.S. Cl.
USPC ..... 148/319; 148/318

(58) Field of Classification Search
USPC ..... 148/318, 319
See application file for complete search history.

(56) References Cited

U.S. PATENT DOCUMENTS

| | | | | |
|---|---|---|---|---|
| 3,738,817 | A * | 6/1973 | Benjamin | 75/235 |
| 4,532,978 | A * | 8/1985 | Kuroki et al. | 164/448 |
| 5,462,808 | A | 10/1995 | Asabe et al. | |
| 5,980,821 | A | 11/1999 | Brill | |
| 7,544,255 | B2 * | 6/2009 | Takayama | 148/318 |

FOREIGN PATENT DOCUMENTS

| | | |
|---|---|---|
| EP | 0 251 295 | 1/1988 |
| EP | 0 688 882 | 12/1995 |
| JP | 07-070712 | 3/1995 |
| WO | WO 2004/067788 | 8/2004 |
| WO | WO 2004/104257 | 12/2004 |
| WO | WO 2005/080622 | 9/2005 |
| WO | WO 2007/064288 | 6/2007 |

* cited by examiner

*Primary Examiner* — Scott Kastler
(74) *Attorney, Agent, or Firm* — Morgan, Lewis & Bockius LLP

(57) ABSTRACT

A roller for a roller hearth furnace comprising a dispersion strengthened steel is disclosed. The roller does not require any coating or reconditioning.

19 Claims, No Drawings

USE AND METHOD OF PRODUCING A DISPERSION STRENGTHENED STEEL AS MATERIAL IN A ROLLER FOR A ROLLER HEARTH FURNACE

This application is a §371 National Stage Application of PCT International Application No. PCT/SE2007/050711, filed Oct. 5, 2007.

The present invention relates to the use of a dispersion strengthened steel. More specifically it relates to the use of a ferritic dispersion strengthened steel as material in a roller for a roller hearth furnace. The present invention also relates to a roller for a roller hearth furnace comprising a ferritic dispersion strengthened steel, to the method of producing such a roller and a roller hearth furnace comprising such a roller.

BACKGROUND

Metallic rollers are used in heat treatment furnaces for the heat treatment of metallurgical products or ceramic products. Typically the rollers are used in roller hearth furnaces for the heat treatment of carbon steel, stainless steel and nickel based alloy products. In the roller hearth furnace, an object to be heat treated is transported through the furnace by means of a plurality of rollers. Rollers are often made from centrifugally cast steel products because of the high strength of such a product and the comparatively low cost of the final product (including material and manufacturing costs). In this case, the roller consists of several parts which are produced separately and subsequently welded together in order to manufacture the roller.

One example of a previously known material for rollers in roller hearth furnaces is an austenitic nickel-chromium alloy comprising 23-30% Cr, 8-11% Fe, 1.8-2.4% Al, 0.01-0.15% Y, 0.01-1.0% Ti, 0.01-1.0% Nb and 0.01-0.2% Zr, as disclosed in U.S. Pat. No. 5,980,821 A. Another example of a previously known material for rollers is a nickel-chromium alloy comprising 55-65% Ni, 19-28% Cr, 0.75-2% Al, 0.2-1% Ti, 0.035-0.1% N, up to 0.1% C, up to 1% each of Si, Mo, Mn and Nb, up to 0.1% B and balance Fe, as disclosed in EP 0 251 295 A2. Yet another example of a previously known material for rollers is a cast nickel-chromium alloy comprising 15-40% Cr, 0.5-13% Fe, 1.5-7% Al, 0.01-0.4% Zr and 0.019-0.089% Y, as disclosed in WO 2004/067788 A1.

Conventional centrifugally cast rollers of Ni—Cr alloys often suffer from insufficient oxidation resistance due to spallation of the surface oxide. Furthermore, there is a risk of formation of surface defects, such as precipitation of hard particles of for example carbides, during use at high temperatures. Therefore, such rollers are often coated with a suitable coating material to prolong the service life. However, this type of roller still typically requires inspection every six months and reconditioning once a year due to the risks of surface defects or spallation of the coating. The total life time of this type of rollers is often in the range of two to three years. Re-conditioning means that the roller has to be removed from the furnace and machined, usually by turning, in order to accomplish the desired surface. In the case of these coated rollers, the roller also has to be re-coated. Reconditioning is a time consuming and costly process, especially since the furnace has to be shut down and the roller removed from the furnace for re-conditioning. Hence, the need for reconditioning reduces the productivity of the roller hearth furnace.

It is therefore an object of the present invention to find a suitable material to be used for rollers, intended for use in roller hearth furnaces for transportation of an object to be subjected to a heat treatment, which minimizes the need for reconditioning of the roller and thereby minimizes the productivity loss of the roller hearth furnace.

SUMMARY

The above identified abject is accomplished by utilizing a ferritic dispersion strengthened steel with the following composition in percent by weight:

| | |
|---|---|
| C | max 0.2 |
| Si | max 1 |
| Mn | max 0.7 |
| Mo | 1.5-5 |
| Cr | 18-25 |
| Ni | max 2 |
| Al | 3-7 |
| N | max 0.2 |
| O | max 0.2 |

at least one element selected from the group consisting of Ta, Hf, Zr and Y up to 2.2 balance Fe and normally occurring impurities.

It has been found that by utilizing the ferritic dispersion strengthened steel in accordance with the present invention, there is no need to coat the roller and no hard particles are formed on the surface of the roller during use. Therefore, there is no need for re-conditioning of the surface of the roller. Furthermore, the oxidation resistance is superior as a result of formation of a stable, inert and well adherent aluminum oxide on the surface during use of the roller.

It is expected that a roller, wherein at least the part of the roller which is to be subjected to the atmosphere and temperature of the roller hearth furnace is made of the dispersion strengthened steel in accordance with the invention, can be used up to at least three years without any need for maintenance measures, even when used at high furnace temperatures such as above 900° C. It is especially suitable at roller hearth furnace temperatures in the range of 1100-1300° C.

The dispersion strengthened steel is produced by powder metallurgy, preferably rapid solidification powder metallurgy.

Even though the present invention is mainly concerned with a roller which is adapted to be in direct contact with the object to be heat treated, the roller according to the present invention may also be used in the case wherein the object to be heat treated is transported through the furnace on a mesh, strip or plate which in turn is supported by the rollers.

DETAILED DESCRIPTION

The ferritic dispersion strengthened steel used in accordance with the present invention has a high mechanical high-temperature strength which enables it to be used even at high furnace temperatures such as above 900° C. The microstructure contains a fine dispersion of stable inclusions. These inclusions provide effective obstacles to dislocation movement and are the basis for the high-temperature creep strength.

The dispersion strengthened steel also has very good form stability at high temperatures. Furthermore, the dispersion strengthened steel has superior corrosion/oxidation properties in normally used atmospheres in roller hearth furnaces compared to conventionally used materials for rollers. This is mainly due to formation of a stable, inert aluminum oxide on the surface of the steel. Moreover, it shows no reaction between oxide layer and the object to be heat treated in the roller hearth furnace, and no hard particles are precipitated on the surface of the steel. The aluminum oxide layer formed on the steel is extremely adherent and has a very slow growth rate, thereby giving the steel an excellent protection against further oxidation and corrosion. Hence, a roller of the dispersion strengthened steel in accordance with the present disclosure has very long service life.

The dispersion strengthened steel use in accordance with the present invention comprises 18-25% Cr, preferably 20-24% Cr, more preferably 20.5-23.5% Cr. The Si content is max 1%, preferably max 0.8%, and the Mn content is max 0.7%, preferably max 0.5%. The Mo content of the dispersion strengthened steel is 1.5-5%, preferably 2-4%. The steel may comprise up to 2% Ni, but preferably to comprises max 1% Ni.

The dispersion strengthened steel comprises 3-7% Al, which is necessary in order to accomplish the stable and inert aluminum oxide on the surface of the steel. Less than 3% would not provide sufficient oxidation resistance since a mixed oxide would form on the surface. The adherence of such a mixed oxide to is the surface is not sufficient at high temperatures and the mechanical loads to which rollers are subjected during use in a roller hearth furnace. According to one embodiment, the Al content of the steel is 4-6%, most preferably 4.5-5.5%.

Furthermore, the dispersion strengthened steel contains at least one of Ta, Hf, Zr and Y, preferably in an amount of at least 0.05%, in order to accomplish the desired dispersion by means of forming oxides, nitrides and/or carbides. The total amount of Ta, Hf, Zr and Y may be up to 2.2% by weight, but is preferably up to 2%, more preferably up to 1%. According to a preferred embodiment, the dispersion strengthened steel contains at least 0.1% of Ta, Hf, Zr and/or Y.

The C content of the dispersion strengthened steel is maximally 0.2%, preferably max 0.15%, since high carbon contents may make it difficult to produce and may make the steel brittle. The N content is max 0.2%, preferably max 0.01-0.1%, more preferably 0.02-0.08%. The oxygen content is max 0.2%, preferably 0.01-0.1%, more preferably 0.03-0.08%. The nitrogen and oxygen is present essentially in the form of nitride and oxide particles respectively. Too high amounts of these elements may make the production of articles from the steel more difficult due to risk of embrittlement.

The ferritic dispersion strengthened steel used in accordance with the present invention is previously known for use in radiant heating tubes, such as cracking tubes in furnaces for cracking hydrocarbons into ethylene.

The ferritic dispersion strengthened steel is produced by Powder Metallurgy (PM) which is necessary in order for the steel to be sufficiently dispersion strengthened.

Dispersion strengthening is one way to improve the mechanical properties of alloys to be used at high temperatures, and has been used for many years in commercial materials produced using powder metallurgical routes. There are two distinctively different versions of the PM route in which the first introduced route is known as Mechanical Alloying (MA). The MA process offers a possibility to introduce a fine distribution of refractory inclusions and involves, in addition to the powder production, an expensive milling step in which the oxides and the metal particles are mixed and the fine particle distribution is formed. The second and more recently introduced class of materials is produced with PM but utilizes rapid solidification of the powder by the gas atomization process to give a fine distribution of inclusions. The inclusions may be oxides, nitrides or carbides, depending on the composition of the steel. The process typically gives inclusions that are lower in number and slightly larger than those obtained by the MA process.

The ferritic dispersion strengthened steel according to the present invention is manufactured by means of the rapid solidification route, i.e. by means of gas atomization, since this enables the most beneficial properties of the steel.

The produced powder is thereafter filled into a capsule and subjected to compaction, such as hot isostatic pressing (HIP), in order to accomplish a solid billet or tube. The billet or tube is thereafter, if needed, formed, e.g. by rolling or extrusion, and/or machined, into the desired shape and surface of the roller.

According to an embodiment of the invention, the roller comprises several different parts wherein at least the part of the roller which is to be subjected to the atmosphere and temperature of the roller hearth furnace is made of the dispersion strengthened steel as described above. The other parts of the roller, such as parts which are subjected to lower temperatures (for examples parts extending through the wall of the furnace or which are in contact with the bearings) may be of other less complex materials since these parts are not exposed to the most severe environments and highest temperatures, and are not in direct contact with the object to be heat treated. The different parts of such a roller may be assembled mechanically or connected by welding depending on the roller design.

The dispersion strengthened steel used in accordance with the present invention is also highly suitable in carburizing and sulphidizing environments and may consequently also be used in furnaces having such environments. The dispersion strengthened steel shows superior performance in these environments compared to materials forming chromium oxides on the surface of the material, such as the Cr—Ni alloys previously described.

A roller in accordance with the present invention was tested in a roller hearth furnace with a 5% oxygen atmosphere. The furnace was shut down during the weekends and the roller was consequently subjected to cyclic conditions. The maximum temperature inside the furnace was 1200° C. and the average temperature was 1100° C. The roller was after six months removed for inspection and compared to a conventional centrifugally cast Ni—Cr roller subjected to the same conditions. The roller according to the present invention had an even surface after the test whereas the conventional roller showed precipitation of hard particles on the surface and an uneven surface caused by spallation of the surface oxide. The roller in accordance with the present invention was thereafter reinstalled in the same furnace during an additional period of six months and subjected to the same temperature and atmosphere, but without the furnace being shut down during this period of time, i.e. essentially constant conditions. The roller was thereafter again removed for inspection. The surface of the roller was still very smooth. From the tests above it is clear that the utilization of the ferritic dispersion strengthened steel improves the life time of the roller and avoids the need of re-conditioning. This in turns leads to fewer shut-downs of the furnace due to need for maintenance measures of the rollers. The result from the first 6 months in operation also shows that the roller according to the present invention is not sensitive to cyclic conditions.

The invention claimed is:

1. A metallic roller for a roller hearth furnace comprising:

a first part to be subject to an atmosphere and temperature of the roller hearth furnace, the first part formed from a ferritic dispersion strengthened steel including the following composition in percent by weight

| | |
|---|---|
| C | max 0.2 |
| Si | max 1 |
| Mn | max 0.7 |
| Mo | 1.5-5 |
| Cr | 18-25 |
| Ni | max 2 |
| Al | 3-7 |
| N | max 0.2 |
| O | max 0.2 |

at least one element selected from the group consisting of Ta, Hf, Zr and Y
up to 2.2
balance Fe and normally occurring impurities, and
a second part,
wherein the first part and the second part are connected mechanically or by welding.

2. The metallic roller according to claim 1 wherein the dispersion strengthened steel includes an Al-content of 4-6 weight %.

3. The metallic roller according to claim 1 wherein the dispersion strengthened steel includes a total content of one or more of the elements selected from the group consisting of Ta, Hf, Zr and Y of 0.05-2 weight %.

4. The metallic roller according to claim 1 wherein the dispersion strengthened steel includes the following composition in percent by weight

| | |
|---|---|
| C | max 0.15 |
| Si | max 0.8 |
| Mn | max 0.5 |
| Mo | 2-4 |
| Cr | 20-24 |
| Ni | max 1 |
| Al | 4-6 |
| N | 0.01-0.1 |
| O | 00.1-0.1 |

at least one element selected from the group consisting of Ta, Hf, Zr and Y 0.05-1
balance Fe and normally occurring impurities.

5. Metallic roller for a roller hearth furnace comprising a first part connected mechanically or by welding to a second part,
wherein the first part of the roller is adapted to transport an object to be heat treated through the roller hearth furnace,
wherein at least the part of the roller which is adapted to be in contact, either directly or through an intermediate mesh, strip or plate, with the object to be heat treated consists of a ferritic dispersion strengthened steel with the following composition in percent by weight

| | |
|---|---|
| C | max 0.2 |
| Si | max 1 |
| Mn | max 0.7 |
| Mo | 1.5-5 |
| Cr | 18-25 |
| Ni | max 2 |
| Al | 3-7 |
| N | max 0.2 |
| O | max 0.2 |

at least one element selected from the group consisting of Ta, Hf, Zr and Y up to 2.2
balance Fe and normally occurring impurities.

6. Metallic roller according to claim 5 wherein the Al-content is 4-6 weight %.

7. Metallic roller according to claim 5 wherein a total content of one or more of the elements selected from the group consisting of Ta, Hf, Zr and Y is 0.05-2 weight %.

8. Metallic roller according to claim 5 wherein the composition of the dispersion strengthened steel is, in percent by weight

| | |
|---|---|
| C | max 0.15 |
| Si | max 0.8 |
| Mn | max 0.5 |
| Mo | 2-4 |
| Cr | 20-24 |
| Ni | max 1 |
| Al | 4-6 |
| N | 0.01-0.1 |
| O | 00.1-0.1 |

at least one element selected from the group consisting of Ta, Hf, Zr and Y 0.05-1
balance Fe and normally occurring impurities.

9. Roller hearth furnace comprising a metallic roller according to claim 5.

10. Method of producing a metallic roller for a roller hearth furnace comprising:
forming a powder of a ferritic dispersion strengthened steel including the following composition in percent by weight

| | |
|---|---|
| C | max 0.2 |
| Si | max 1 |
| Mn | max 0.7 |
| Mo | 1.5-5 |
| Cr | 18-25 |
| Ni | max 2 |
| Al | 3-7 |
| N | max 0.2 |
| O | max 0.2 |

at least one element selected from the group consisting of Ta, Hf, Zr and Y up to 2.2
balance Fe and normally occurring impurities by melting followed by gas atomization,
filling a capsule with the powder of the steel, and
forming a dense billet by compaction, and
optionally subjecting the billet to subsequent forming and/or machining in order to accomplish the final shape and/or surface finish.

11. A metallic roller comprising a first part connected mechanically or by welding to a second part, the first part comprising a ferritic dispersion strengthened steel including the following composition, in percent by weight:

| | |
|---|---|
| C | max 0.2 |
| Si | max 1 |
| Mn | max 0.7 |
| Mo | 1.5-5 |
| Cr | 18-25 |
| Ni | max 2 |
| Al | 3-7 |
| N | max 0.2 |
| O | max 0.2 |

at least one element selected from the group consisting of Ta, Hf, Zr and Y up to 2.2, and balance Fe and normally occurring impurities.

12. The metallic roller of claim 11, wherein the dispersion strengthened steel includes the following composition, in percent by weight:

| | |
|---|---|
| C | max 0.15 |
| Si | max 0.8 |
| Mn | max 0.5 |
| Mo | 2-4 |
| Cr | 20-24 |
| Ni | max 1 |
| Al | 4-6 |
| N | 0.01-0.1 |
| O | 00.1-0.1 |

at least one element selected from the group consisting of Ta, Hf, Zr and Y 0.05-1, and balance Fe and normally occurring impurities.

13. The metallic roller of claim 11, wherein the metallic roller is non-coated.

14. The metallic roller of claim 11, wherein the metallic roller is non-reconditioned.

15. The metallic roller of claim 11, wherein no hard particles are precipitated on the surface of the steel.

16. The metallic roller of claim 1, wherein no hard particles are precipitated on the surface of the steel.

17. The metallic roller of claim 5, wherein no hard particles are precipitated on the surface of the steel.

18. The method of claim 10, wherein no hard particles are precipitated on the surface of the steel.

19. The method of claim 10, wherein forming the dense billet by compaction uses hot isostatic pressing.

* * * * *